US007160171B1

(12) United States Patent
Rehkemper et al.

(10) Patent No.: US 7,160,171 B1
(45) Date of Patent: Jan. 9, 2007

(54) PNEUMATIC PUMP AND VEHICLE

(75) Inventors: Jeffrey Rehkemper, Chicago, IL (US); Scott May, Chicago, IL (US); Charles Hartlaub, Glendale Heights, IL (US)

(73) Assignee: Rehco, LLC, Chicago, IL (US)

( * ) Notice: Subject to any disclaimer, the term of this patent is extended or adjusted under 35 U.S.C. 154(b) by 188 days.

(21) Appl. No.: 10/847,608

(22) Filed: May 17, 2004

Related U.S. Application Data

(63) Continuation-in-part of application No. 10/370,992, filed on Feb. 24, 2003, now Pat. No. 7,036,307.

(51) Int. Cl.
*A63F 9/14* (2006.01)
*A53H 18/00* (2006.01)

(52) U.S. Cl. ..... 446/429; 446/444; 446/180; 273/108; 273/129 AP

(58) Field of Classification Search ..... 446/176, 446/178–180, 429, 444, 199, 430; 273/108, 273/129 AP
See application file for complete search history.

(56) References Cited

U.S. PATENT DOCUMENTS 3,740,896 A * 6/1973 Glass et al. ..... 446/212
3,789,540 A * 2/1974 Convertine et al. ..... 446/180
3,936,053 A * 2/1976 Goldfarb et al. ..... 273/108
4,174,587 A * 11/1979 Morin et al. ..... 446/192
4,329,806 A * 5/1982 Akiyama et al. ..... 446/180
4,513,967 A * 4/1985 Halford et al. ..... 273/108
2003/0040254 A1* 2/2003 Greenberg ..... 446/427

FOREIGN PATENT DOCUMENTS

GB 1352819 A * 4/1974
JP 2000042258 A * 2/2000

* cited by examiner

*Primary Examiner*—Stephen Blau
*Assistant Examiner*—Urszula M. Cegielnik

(57) ABSTRACT

In accordance with the present invention there is provided a pneumatic pump in combination with a pneumatic toy vehicle powered by a refillable compressed chamber. The improvement of the pump is defined by having a pipe that has an aperture to exhaust air being pumped therefrom. The pump further includes a means for launching the vehicle from the pump. The toy vehicle includes a pneumatic motor that when activated utilizes air in the chamber to propel the vehicle and activation of the motor is achieved by moving the vehicle. The vehicle includes an air inlet valve sized to securely engage the pipe of the pump such that movement of the vehicle during filling of the chamber is prevented. When securely engaged by the pipe, the vehicle is positioned against the launching means. A user operating the launching means pushes the vehicle, which activates the motor, such that the vehicle launches away from the pump.

11 Claims, 8 Drawing Sheets

PNEUMATIC PUMP AND VEHICLE

CROSS REFERENCE TO RELATED APPLICATIONS

The present invention is a Continuation in Part of Ser. No. 10/370,992 filed Feb. 24, 2003 now U.S. Pat. No. 7,036,307.

FIELD OF THE INVENTION

The present invention relates to a pneumatic pump used to charge pneumatic operated devices and more particularly to a pneumatic pump that engages the device during filling and launches the device once the device is charged.

BACKGROUND OF THE INVENTION

Pneumatic operated devices, such as vehicles, are known in the art. These vehicles require at the very least a chamber to hold a pressurized fluid and a pump of some kind to re-fill or charge the reservoir. The pumps are attached to an intake valve on the vehicle and then a reciprocating pump handle is used to charge the reservoir. Upon activated, virtually all of the pneumatic operated vehicles utilize substantially all of the air in the reservoir to move the vehicle. Moreover, most pneumatic operated vehicles are activated by pushing the vehicles across a surface. If the vehicle is unintentionally moved or pushed across a surface during filling the vehicle may prematurely launch. In these instances, the full potential of the vehicle's travel will not be realized and the user may become disinterested in playing with the vehicle. As such it is desirable to maintain or hold these vehicles stationary until the reservoir is filled and the user is ready to launch the device.

While some prior patents have attempted to solve this problem for flying vehicles, the prior art has not addressed the issue as it relates to wheeled vehicles. U.S. Pat. No. 6,079,954 is directed to an air pumping station for pneumatic planes that suspends the plane in the air to protect the structure of the plane and prevent the propellers from unintentionally rotating. U.S. Pat. No. 5,415,153 is directed to a pressurized rocket launcher that holds the rocket vertically until the user desires to launch the rocket.

A need, therefore, exists to improve upon the prior art to provide a pneumatic pump that prevent the pneumatic operated vehicle from prematurely launching and/or expelling the pressurized air held inside.

SUMMARY OF THE INVENTION

In accordance with the present invention there is provided a pneumatic pump in combination with a pneumatic toy vehicle powered by a chargeable compressed air chamber. The improvement of the pump is defined by having a pipe that has an aperture to exhaust air being pumped out of the pneumatic pump. The pipe further has a predetermined diameter. The pump further includes a means for launching the vehicle from the pneumatic pump. The launching means is defined by having a frame that selectively slides along the exhaust pipe. The frame includes at least one pin that extends outwardly from the frame, and includes a lever that abuts the frame and pivots when pressed downwardly to selectively slide the frame along the exhaust pipe such that the pin extends out of openings defined in the stabilizing base. The toy vehicle includes a pneumatic motor that utilizes compressed air in the chamber to propel the vehicle. The pneumatic motor upon activation continuously uses the compressed air in the chamber until the compressed air in the chamber is substantially exhausted. Furthermore, activation of the pneumatic motor is achieved by moving the vehicle with the pump lever. The vehicle further includes an air inlet valve sized to securely engage the pipe of the pump such that movement of the vehicle during filling of the chamber is prevented. When the vehicle is securely engaged by the pipe, the vehicle is positioned against the openings defined in the stabilizing base.

When the vehicle is securely engaged by the pipe of the pump and the lever defined by the pump is pushed downwardly, the pins extend out of the openings defined in the stabilizing base to engage and move the vehicle such that the pneumatic motor is activated and the vehicle launches away from the pump.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
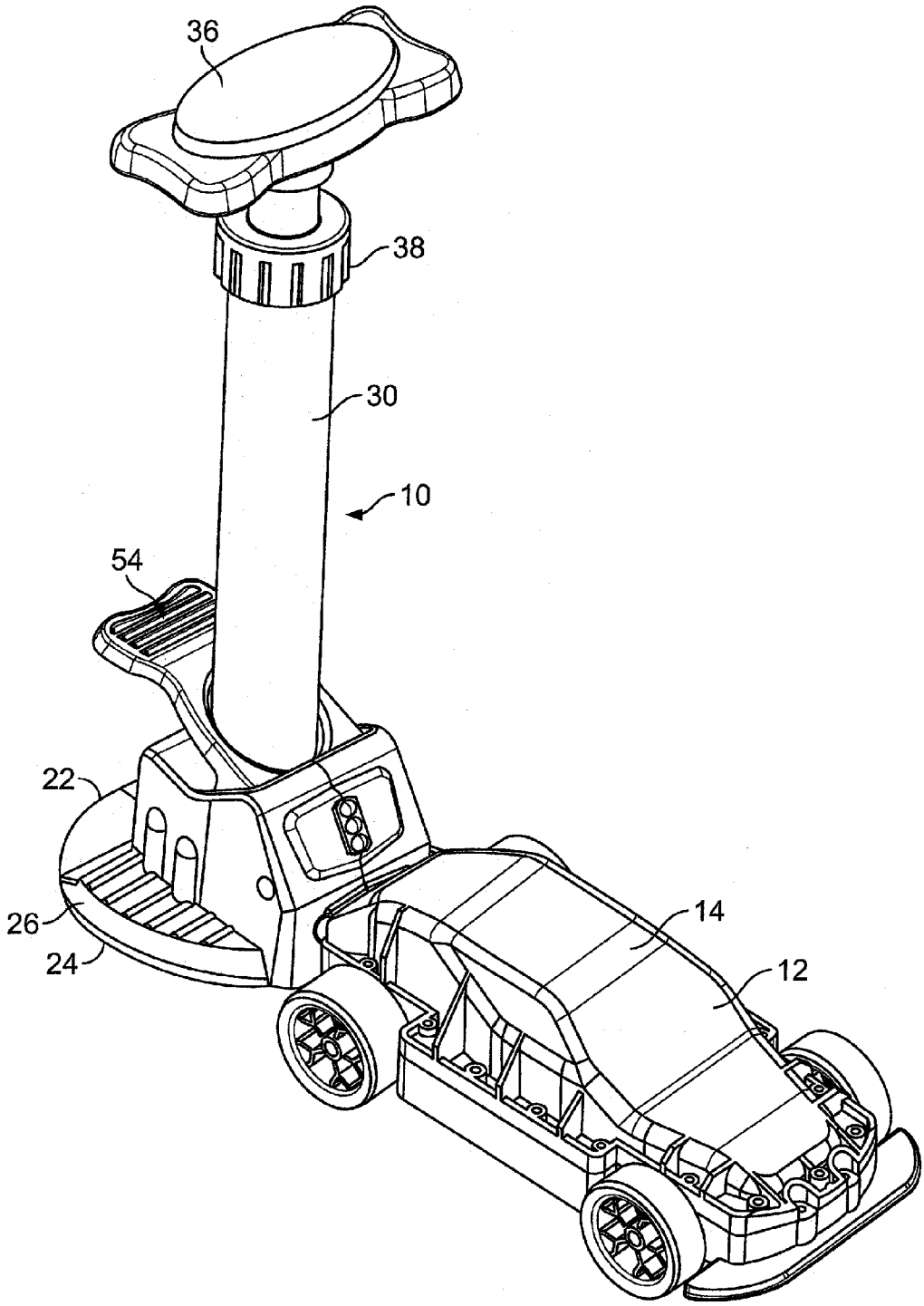
FIG. 1 is a perspective view of a pneumatic pump assembly in accordance with the present invention illustrated as attached to a toy car.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Figure 2:
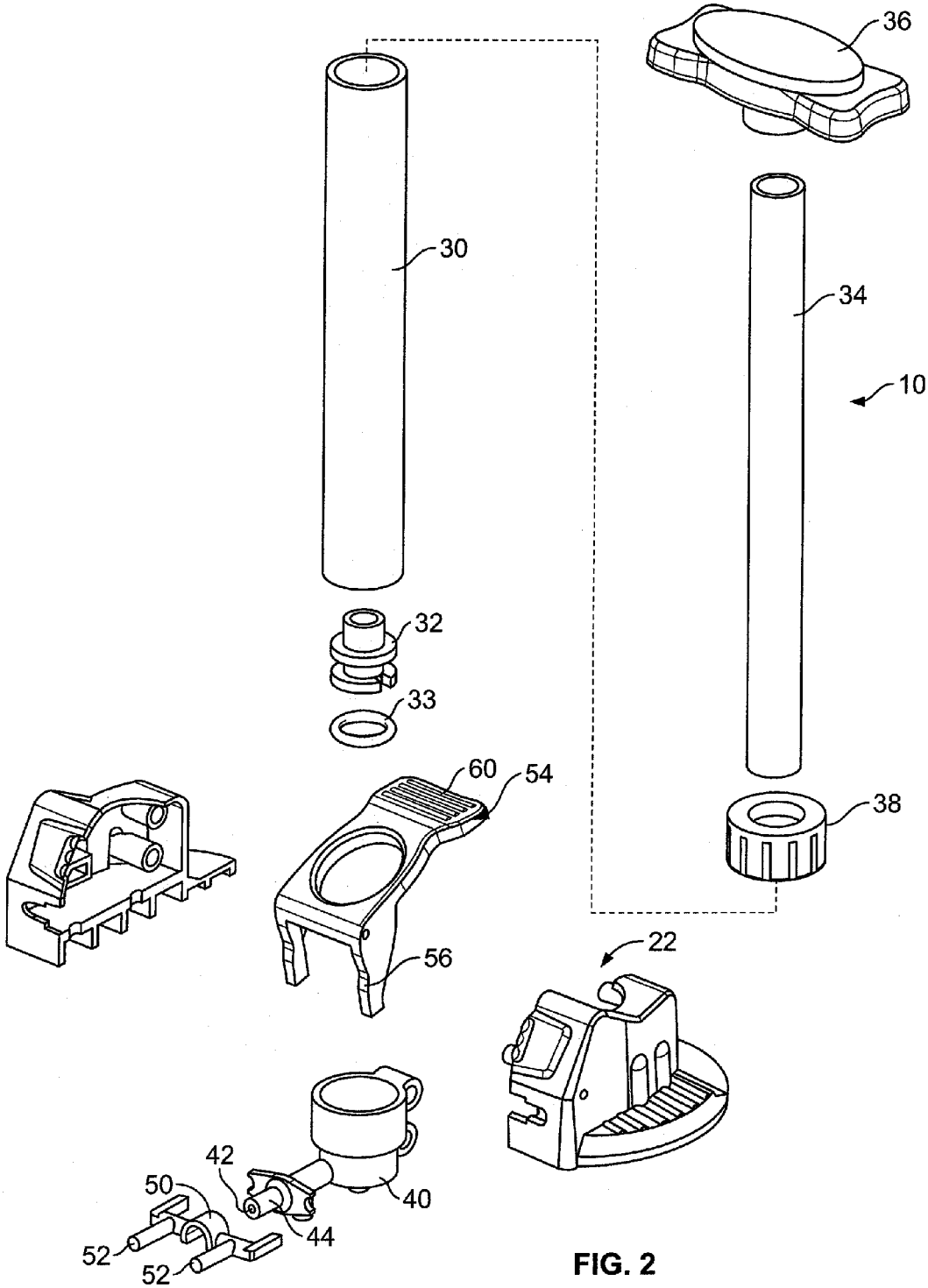
FIG. 2 is an exploded view of the pneumatic pump assembly from FIG. 1.

With reference to the perspective view of FIGS. 1 and 2, a pneumatic launching station may be seen to include a pneumatic pump 10 adapted for use with a pneumatic operated vehicle, such as a car 12. The vehicle includes therein a rechargeable pneumatic power supply 14 such as a re-fillable/re-usable compressed air chamber.

The pneumatic pump 10 includes a two piece stabilizing base 22. The stabilizing base includes a flat ground engaging horizontal bottom 24. The stabilizing base 22 also includes horizontally outwardly projecting members 26 that are located on either side of the stabilizing base 22 and which are proportioned for placement underneath the feet of a user of the pneumatic pump 10.

The pneumatic pump 10 further includes a fluid-tight vertical cylindrical housing 30 to which is secured the stabilizing base 22. The cylindrical housing 30 includes a piston 32 which is situated in fluid-tight relationship to the interior walls of the cylindrical housing 30 via a piston o-ring 33. A rod 34 connects the piston 32 to a hand grippable pumping means or handle 36 at the opposite end thereof. As such when the feet of the user are upon the projecting members 26 and the handle 36 is engaged by the hands of the user, an anatomic stability will exist as the handle 36, the rod 34, and the piston 32 are reciprocated relative to the cylindrical housing 30. It is noted that cylindrical housing 30 includes a top cap 38 necessary to prevent the rod 34 and piston 32 from being extended out of the cylindrical housing 30.

Air pushed through the cylindrical housing 30 travels through a nozzle 40 and out an air exhaust aperture 42. Unlike typical pneumatic pumps, the present invention further includes a means for locking a vehicle to the pneumatic pump 10 and a means for launching the vehicles from the pneumatic pump 10.

The means for locking a vehicle to the pneumatic pump is defined by having an external exhaust pipe 44, which has the air exhaust aperture 42 defined thereon. The external exhaust aperture has a diameter slightly less than a diameter defined by an air inlet aperture 102 on the vehicle (shown in FIG. 6). This permits the air exhaust pipe 44 to frictionally engage the air inlet 102 and thus securely hold the vehicle in place during charging of the vehicle.

The means for launching the vehicle from the pneumatic pump 10 is defined by having a frame 50 that selectively slides along the external exhaust pipe 44. The frame 50 includes at least one pin 52 that extends outwardly from the frame 50. The frame 50 abuts a lever 54 that pivots to slide the frame 50 along the exhaust pipe 44 such that the pin 52 extends out of the stabilizing base 22 when the lever 54 is pushed downwardly.

Figure 3:
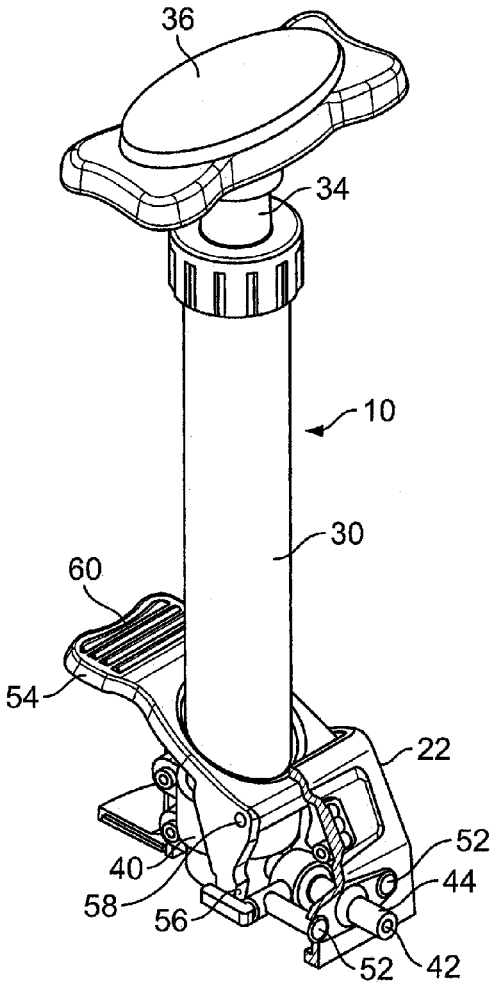
FIG. 3 is a perspective view of the pneumatic pump assembly from FIG. 1 partially showing a means for locking a vehicle to the pneumatic pump assembly and a means for launching the vehicles from the pneumatic pump assembly.
Figure 4:
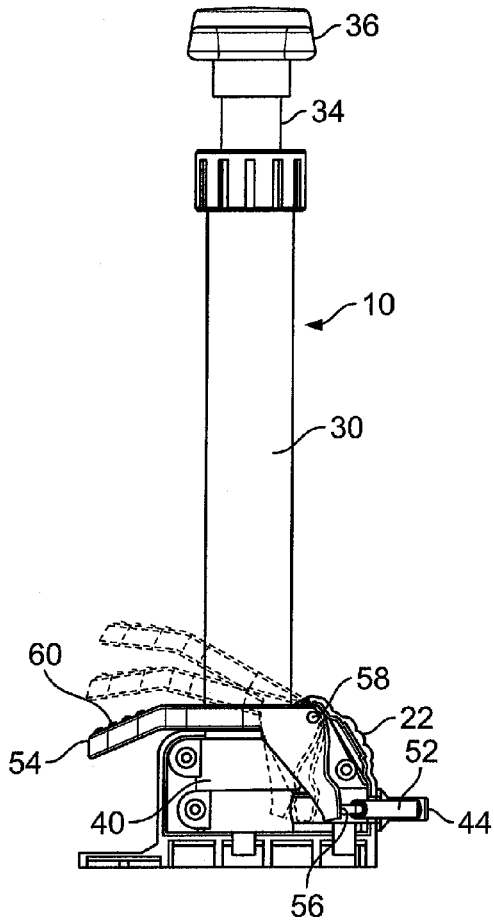
FIG. 4 is a side view of the pneumatic pump assembly from FIG. 1 illustrating the means for launching the vehicles from the pneumatic pump assembly.
Figure 5:
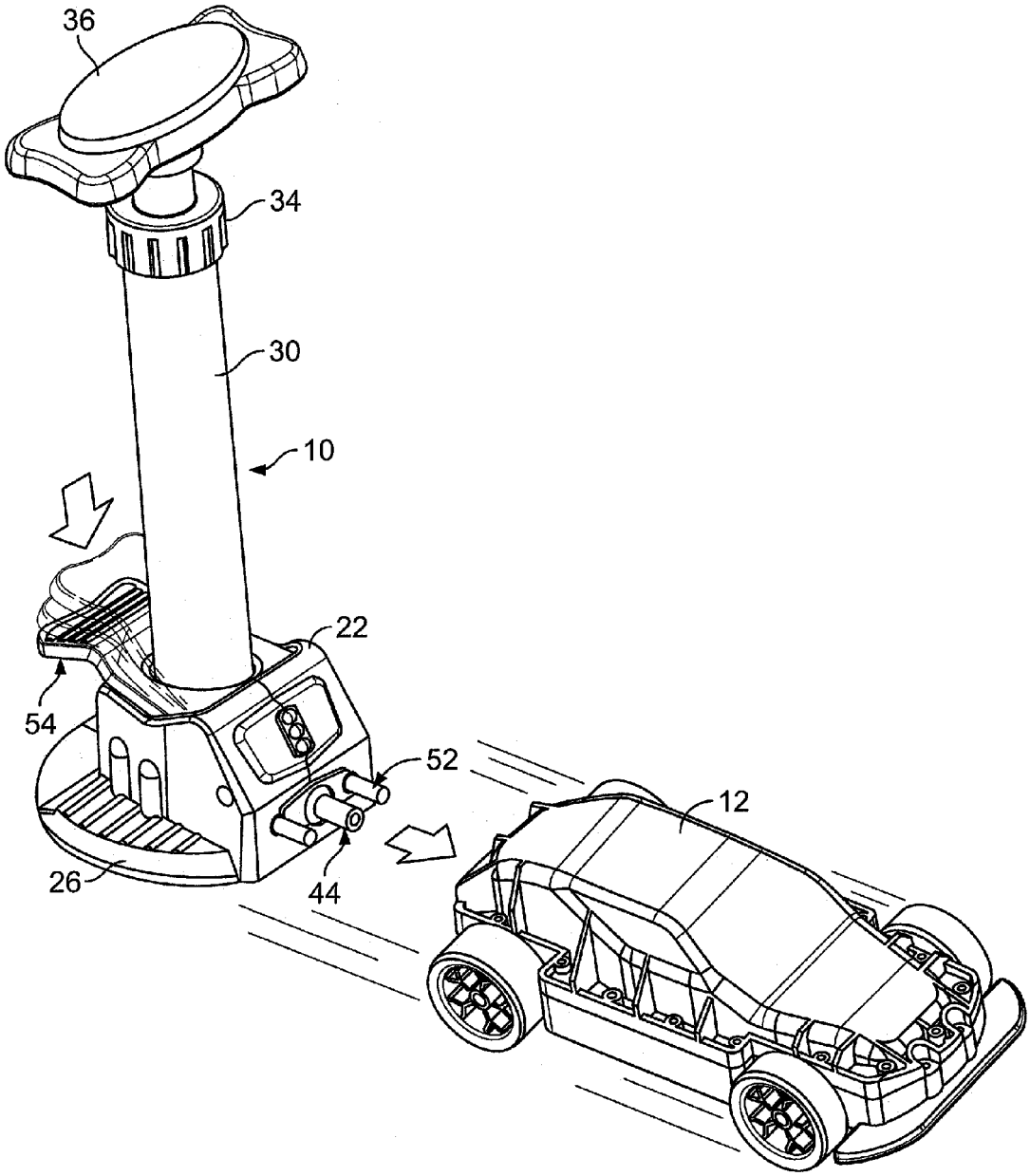
FIG. 5 is a perspective view of the pneumatic pump assembly and toy car from FIG. 1 illustrating the car launched from the pneumatic pump assembly.

In operation, FIG. 1, the car 12 is attached to the pneumatic pump 10 by engaging or mating the inlet aperture 102 on the vehicle to the external exhaust pipe 44. This will push any pins 52 on the frame 50 of the launching means into the stabilizing base 22. Moreover, illustrated in FIG. 3, the frame 50 will slide backwardly such that it will abut the lower portion 56 of the lever 54. The lever 54 pivots about a pivot point 58 defined in top front portion of the stabilizing base 22. The pneumatic pump 10 is operated by a user as described above, such that the user pumps air into the car 12. After the user is finished pumping air into the car 12, the user may push (with a foot or hand) downwardly on the upper portion 60 of the lever 54, illustrated in FIGS. 4 and 5. The lever 54 pivots pushing the frame 50 forward. As the frame 50 slides forward, the pins 52 extend out of the stabilizing base 22 and engage the car 12. As the lever 54 is pushed further downwardly, the car 12 is forced off of the air exhaust pipe 44. In addition, as explained below, once the wheels of the car 12 begin moving, the pneumatic motor in the car 12 initiates to help power the vehicle off of the air exhaust pipe 44. Once free of the air exhaust pipe 44, the car 12 launches itself away from the pneumatic pump assembly 10.

Figure 6:
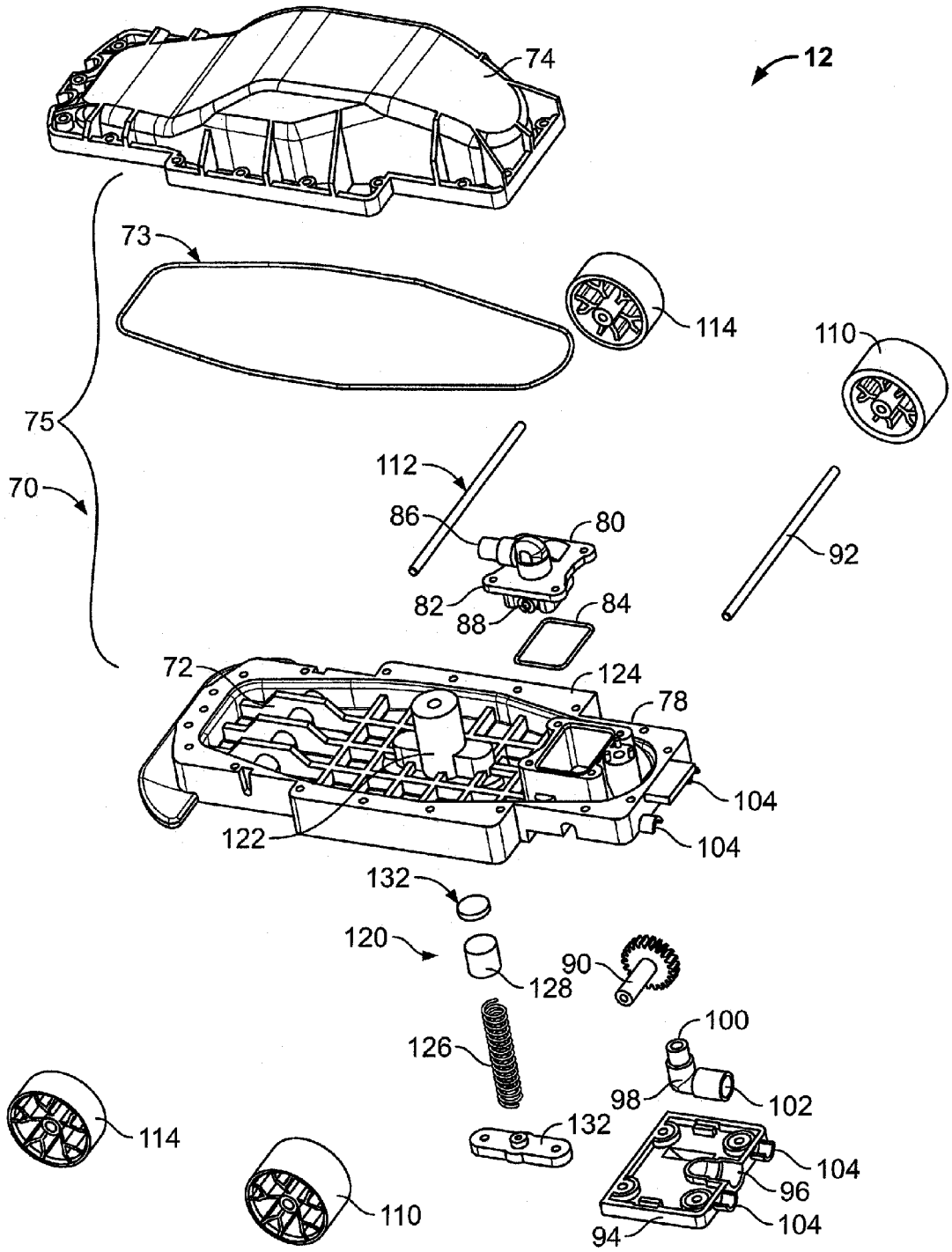
FIG. 6 is an exploded view of the car used with the pneumatic pump assembly.

Referring now to FIG. 6, in one of embodiment, the vehicle includes a pneumatic power supply 70, such as defined in co-owned U.S. patent application Ser. No. 10/370,992 incorporated herein by reference. The pneumatic power supply 70 includes a first housing 72 and a second housing 74 and a seal 73 between the two, which when assembled forms a fluid tight chamber 75 therebetween.

The first housing 72 includes a motor receptacle 78 that is designed to accommodate a pneumatic motor 80. The motor receptacle 78 also includes an opening (not shown) through the first housing 72. The pneumatic motor 80 includes a motor housing 82 that fits into a seal 84 and rests in the motor receptacle 78 to create a fluid tight seal between the interior of the chamber 75 and the opening through the first housing 72. The pneumatic motor 80 also includes a fluid inlet 86. When the pneumatic motor 80 is placed in the motor receptacle 78, the fluid inlet 86 is directly in communication with the interior of the chamber. Below the seal 84, in the opening, the pneumatic motor 80 includes a motor gear 88 which is driven by the pneumatic motor, to rotate an axle gear 90 and axle 92. A housing plate 94 is attached to the first housing 72 below the motor receptacle 78 to secure the axle and axle gear in place and cover the opening. The housing plate 94 further includes a channel 96 that receives a one-way inlet valve 98. The one-way inlet valve includes an exit 100 open to the interior of the chamber and the inlet aperture 102 sized to engage the external exhaust pipe 44 on the pneumatic pump 10.

The housing plate 94 when attached to the housing 72 creates a pair of exhaust cylinders 104. The exhaust cylinders 104 are aligned such that the pins 52 on the pneumatic pump assembly 10 will push against the exhaust cylinder 104 when the lever 54 is pushed downwardly, such that the vehicle 12 will be launched from the pneumatic pump assembly 10.

Still referring to FIG. 6, the chamber includes a pressure release valve 120 that is entirely disposed within the chamber. The pressure release valve 120 includes a valve housing 122 that is entirely disposed within and secured to the interior of the chamber 75. The valve housing 122 includes an aperture 124, which is open to the interior of the chamber 75. The pressure release valve 120 also includes a spring 126, a cap 128, and a flapper valve 130 all of which is contained within the valve housing 122. The spring 126 is secured on one end to a pressure release cover 132 that is secured to the underside of the first housing 72. The spring 126 has a predetermined compression force that sets the optimum pressure allowed inside the chamber 75. As the pressure within the chamber 75 reaches and exceeds the predetermined optimum pressure defined by the compression force preset by the spring 126, the fluid pushes past the flapper valve 132 causing the spring 126 to compress. The fluid continues to move the cap 128 to allow air to seep around the cap 128 and vent; relieving the pressure in the chamber below the optimum pressure defined by the spring 126. The spring 126 will then return the cap 128 to a position that prevents the flapper valve 132 from moving sealing off the chamber.

The pneumatic motor 80 in operation draws pressurized fluid from the interior of the chamber 75 through the fluid inlet 86 to drive the motor gear 88. The pneumatic motor 80 will typically include a piston and valve that alternate or reciprocate to permit air into a piston chamber to rotate the piston, which opens the valve to allow more air into the piston chamber. The pressurized fluid used by the pneumatic motor 80 is vented by the pneumatic motor 80 below the plug through the motor receptacle 78 and allowed to vent through a motor vent (not shown) in the housing plate 94. The pneumatic motor 80 uses the pressurized fluid to drive the axle 92 which extends out of the chamber and drives or rotates a first pair of wheels 110. The first housing 72 also includes a second axle 112 that freely rotates a second pair of wheels 114. Similar pneumatic motors and their operation are known in the art, such as commonly assigned U.S. Pat. No. 6,626,079, which is incorporated by reference. To initiate the pneumatic motor 80, after the chamber is filled with air, the user begins to rotate one of the first pair of wheels 110. The rotation of the first pair of wheels, turns the axle 92 and begins rotating the piston in the pneumatic motor which opens the valve to draw more air through the fluid inlet 86 of the pneumatic motor into the piston chamber and continues to rotate the piston which turns the axle 92. Once the pneumatic motor is initiated, the motor cycles pressurized air into piston chamber to continuously rotate the axle 92, such that the pneumatic motor will continue to operate and propel the vehicle until the pressurized air in the chamber is no longer capable of running the pneumatic motor 80.

Figure 7:
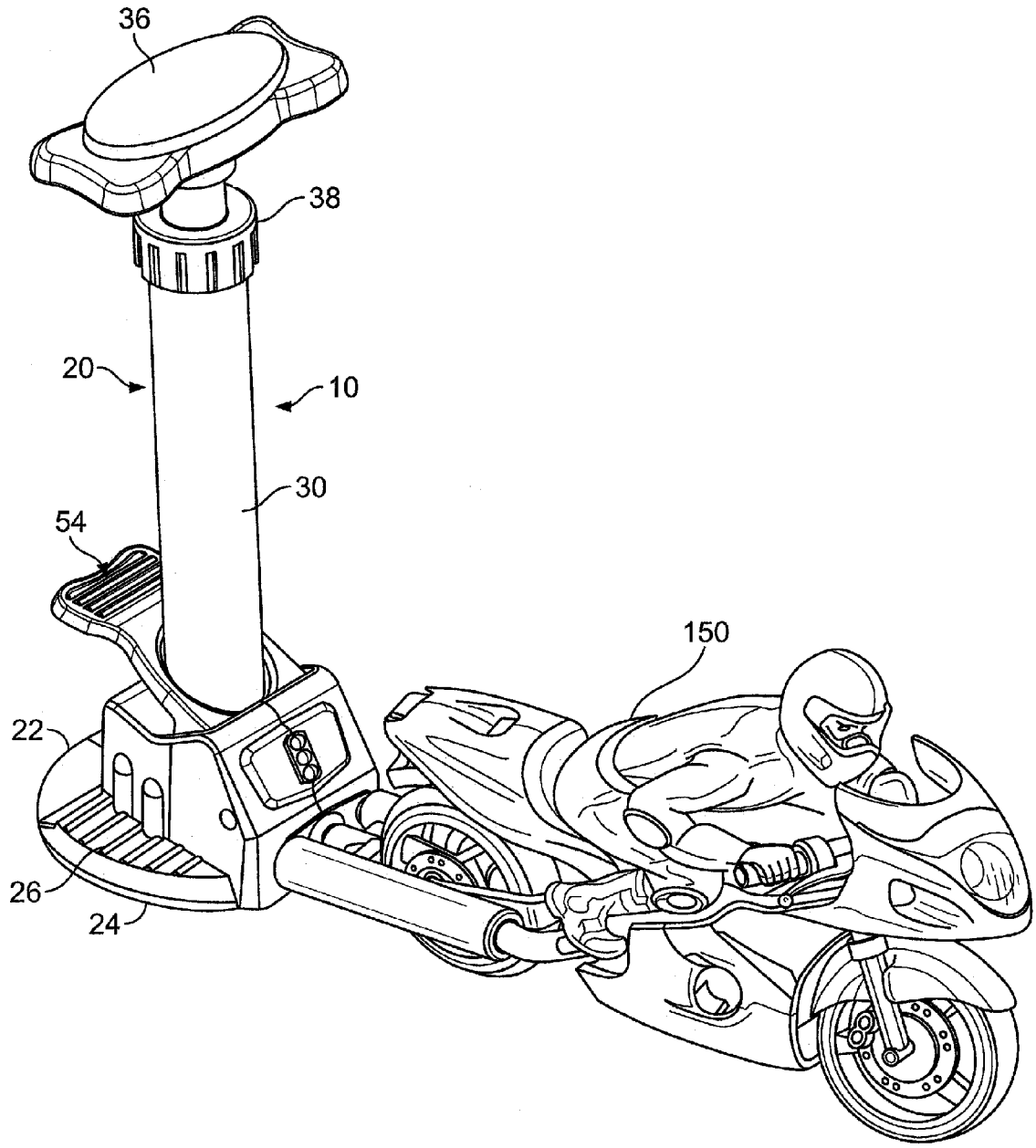
FIG. 7 is a perspective view of the pneumatic pump assembly in accordance with the present invention and a motorcycle illustrated with the motorcycle secured against the pneumatic pump assembly.
Figure 8:
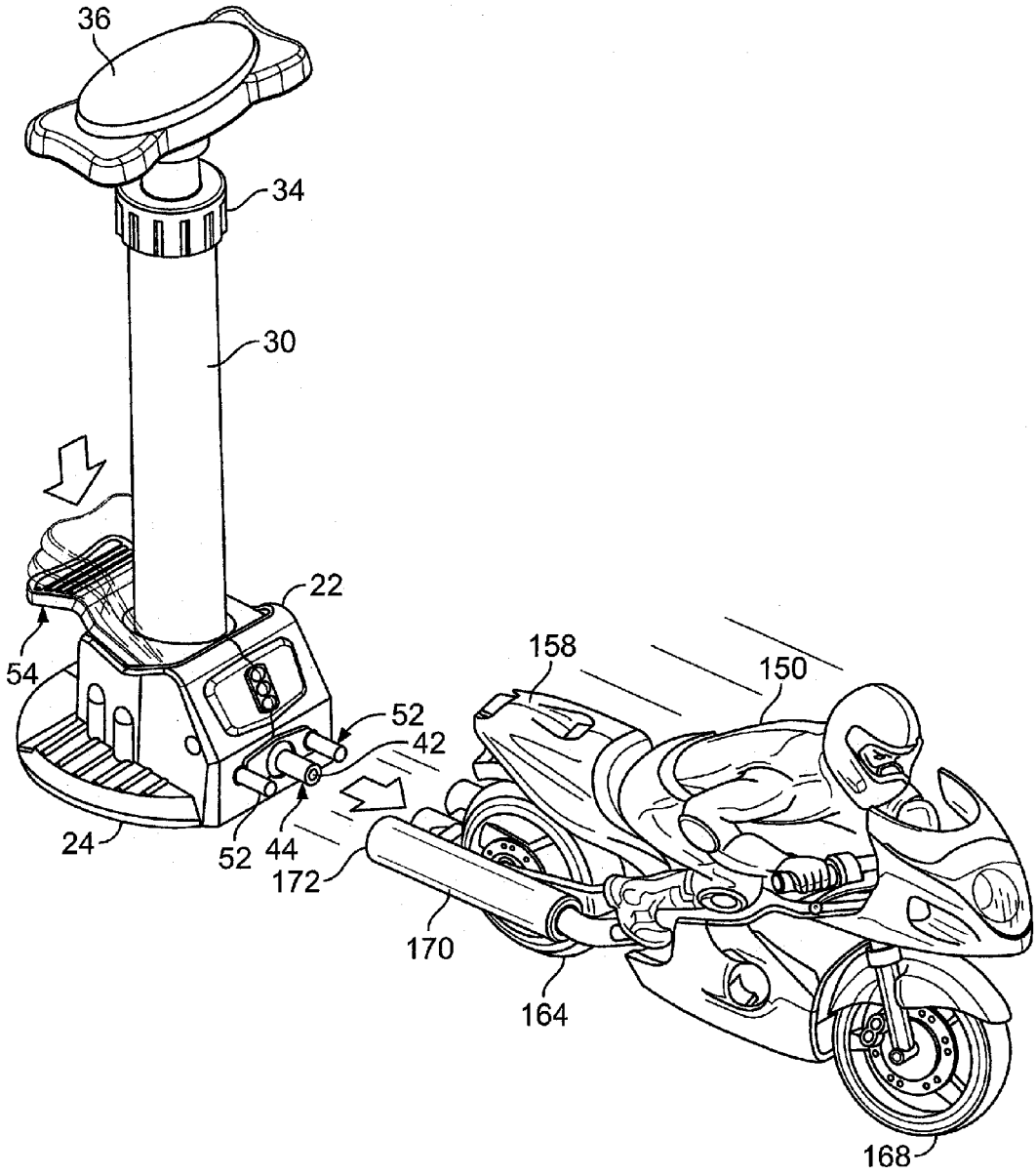
FIG. 8 is a perspective view of the pneumatic pump assembly and motorcycle from FIG. 7 illustrated with the motorcycle launched from the pneumatic pump assembly.
Figure 9:
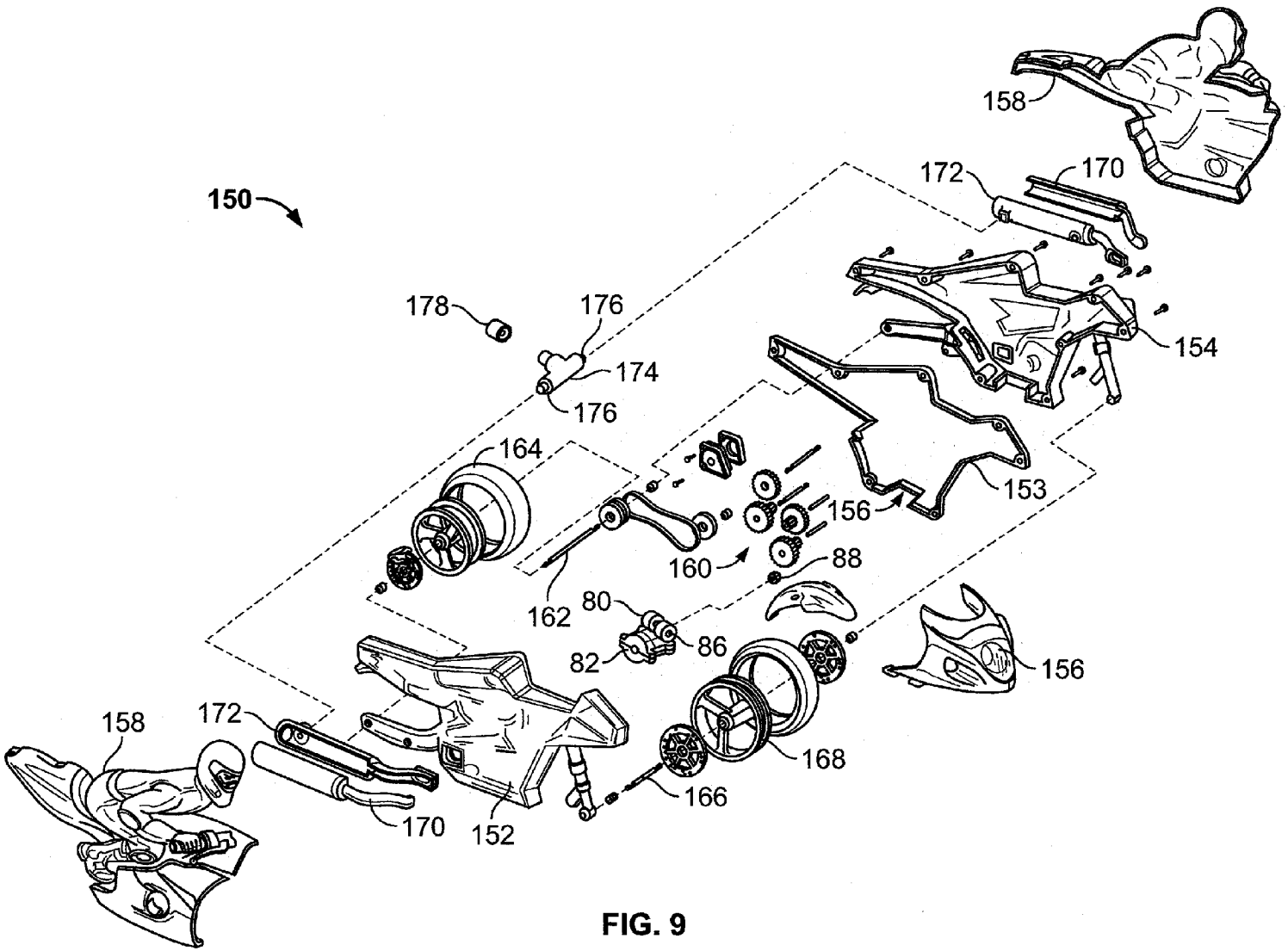
FIG. 9 is an exploded view of the motorcycle from FIG. 7.

Referring now to FIGS. 7 through 9, the vehicle may also be a motorcycle 150. The motorcycle 150 includes a first housing 152 and a second housing 154 with a seal 153 between the two such that when assembled a fluid tight chamber is formed between the housings. Outer housing elements 156 and 158 may be used to add features to the motorcycle 150.

When the housings are assembled a motor receptacle 156 is defined to accommodate a pneumatic motor 80. The pneumatic motor 80 includes a motor housing 82 that fits in the motor receptacle 156 to create a seal between the interior and exterior of the chamber. The pneumatic motor 80 also includes a fluid inlet 86. When the pneumatic motor 80 is placed in the motor receptacle 156, the fluid inlet 86 is directly in communication with the interior of the chamber. The pneumatic motor 80 includes a motor gear 88 that meshed to a gear train 160. The gear train 160 drives an axle 162 that rotates a rear wheel 164. A front axle 166 is also provided to freely rotate a front wheel 168.

Attached to the housings are external exhaust cylinders 170 that are aligned such that the pins 52 on the pneumatic pump 10 will push against closed ends 172 of the exhaust cylinder 170 (when the lever 54 is pushed downwardly) such that the vehicle 12 will be launched from the pneumatic pump 10.

The external exhaust cylinders 170 are hollow and in fluid communication with the chamber defined by the assembled housings. The external exhaust cylinders 170 further include inlets to receive a one way inlet valve 174. The one-way inlet valve 174 includes a pair of exits 176, each separately attached to the external exhaust cylinders 170 and the inlet aperture 178 is sized to securely engage the external exhaust pipe 44 on the pneumatic pump 10.

When the motorcycle 150 is attached to the pneumatic pump 10 (FIG. 7) the inlet aperture 178 will engage the external exhaust pipe 44 and securely fasten the motorcycle to the pneumatic pump assembly 10. Air pumped into the motorcycle will travel out the pair of exits 176 on the one-way inlet valve 174 through the external exhaust cylinder 170 and into the chamber of the motorcycle 150. When the user is done pumping air into the motorcycle 150 (FIG. 8) the user presses the lever 54 downwardly, forcing the pins 52 out of the pneumatic pump 10 to engage the closed ends 172 of the external exhaust cylinders 170. The pins 52 will push the motorcycle 150 off of the external exhaust pipe 44 which will also rotate the rear wheel 164. The rotation of the rear wheel 164 will rotate the motor gear 88 and initiate the pneumatic motor 80 such that the motorcycle 150 will launch off of the pneumatic pump 10.

From the foregoing and as mentioned above, it will be observed that numerous variations and modifications may be effected without departing from the spirit and scope of the novel concept of the invention. It is to be understood that no limitation with respect to the specific embodiments illustrated herein is intended or should be inferred. It is, of course, intended to cover by the appended claims all such modifications as fall within the scope of the claims.

We claim:

1. A pneumatic pump for use with a toy vehicle that includes a pneumatic motor powered by a refillable chamber containing compressed air and an inlet, and wherein the pneumatic motor drives a wheel defined thereby and movement of said wheel initiates said pneumatic motor to utilize pressurized air in the chamber of said vehicle to continue driving said wheel such that said wheel when on a surface moves said toy vehicle, the pump comprising:

an air exhaust pipe having an exhaust aperture in a housing defined by the pump for engagement with said inlet such that the pump is utilized to re-fill the chamber of said vehicle;

a means for releasably securing the vehicle to the air exhaust pipe such that the vehicle is prevented from moving during filling of the chamber, wherein the securing means includes a diameter defined by the air exhaust pipe that is sized to fictionally engage the inlet defined on the vehicle such that the frictional engagement holds the vehicle against the pneumatic pump during the filling of said chamber; and a means for launching the vehicle from the pneumatic pump, that initiates the pneumatic motor, wherein the launching means is defined by having a frame that includes at least one pin that extends outwardly from the frame, a lever abutting the frame that pivots when pressed downwardly to move the such that the pin extends out of openings defined in the pneumatic pump and wherein the vehicle is positioned against said openings and prevented from moving away from said pump provided that when the lever is pushed downwardly, the pins extend out of the openings to move the vehicle and launch the vehicle away from the pneumatic pump, and wherein the vehicle includes a pneumatic motor that drives a gear which is meshed to wheels defined thereon and movement of said wheels initiates said pneumatic motor to utilize pressurized air in the chamber of said vehicle, whereby virtue of the launching means moving said vehicle initiates said pneumatic motor.

2. The combination of claim 1, wherein the pneumatic pump further includes a stabilizing base with a flat bottom including projecting members, a fluid-tight longitudinal pump housing secured, at a distal end thereof, to the stabilizing base, a rod positioned within the housing and having a distal end with a piston attached thereto, the piston in fluid tight relationship to interior walls of the housing, the rod having a proximal end defining a handle for reciprocal movement of the piston within the housing.

3. The combination of claim 1, wherein the vehicle is a motorcycle that includes a pair of rearward extending hollow pipes, each rearward extending hollow pipe includes an aperture, a one way valve positioned between said rearward extending hollow pipes includes an inlet opening for engagement to the air exhaust pipe of the pump and includes a pair of outlets separately secured to the apertures of the rearward extending hollow pipes.

4. The combination of claim 3, wherein the rearward extending hollow pipes defined by the motorcycle include end caps, at least one said end cap being positioned against the opening defined in the pump when the motorcycle is releasably secured to the pump during refilling of a chamber in the motorcycle.

5. An improved pneumatic pump for use with a pneumatic toy vehicle powered by a refillable chamber of compressed air, the improvement comprising:

a pipe having an aperture to exhaust air being pumped out of the pneumatic pump, the pipe having a predetermined diameter to releasably engage an air inlet valve of the toy vehicle; and a means for launching the vehicle from the pneumatic pump, the launching means is defined by having a frame that includes a pair of pins that extends outwardly from the frame, a lever abuts the frame and pivots when pressed downwardly to selectively move the frame such that the pins extends out of openings defined pneumatic pump, said pneumatic toy vehicle includes a pneumatic motor that drives a gear which is meshed to wheels defined thereon and movement of said wheels initiates said pneumatic motor to utilize pressurized air in the chamber of said vehicle, wherein when the air inlet of the toy vehicle is engaged by the pipe, the vehicle is releasably secured to the pump and positioned against the openings defined in the pump such that when the lever is pushed downwardly, the pins extend out of the openings to engage the vehicle and launch the vehicle away from the pneumatic pump, whereby when the launching means moving said vehicle said pneumatic motor initiates.

6. The improved pneumatic pump for use with a pneumatic toy vehicle of claim 5, wherein the pneumatic pump further includes a stabilizing base with a flat bottom including projecting members, a fluid-tight longitudinal pump housing secured, at a distal end thereof, to the stabilizing base, a rod positioned within the housing and having a distal end with a piston attached thereto, the piston in fluid tight relationship to interior walls of the housing, the rod having a proximal end defining a handle for reciprocal movement of the piston within the housing.

7. The improved pneumatic pump for use with a pneumatic toy vehicle of claim 5, wherein the vehicle is a motorcycle that includes a pair of rearward extending hollow pipes in communication with the refillable chamber, each rearward extending hollow pipe includes a closed end and an aperture defined along each hollow pipe, a one way valve in communication with the apertures defined on the hollow pipes includes an inlet opening for engagement to the air exhaust pipe of the pump.

8. The improved pneumatic pump for use with a pneumatic toy vehicle of claim 7, wherein the closed ends are positioned against the openings defined in the pump when the motorcycle is releasably secured to the pump during refilling of a chamber in the motorcycle.

9. The improved pneumatic pump for use with a pneumatic toy vehicle of claim 5, wherein the vehicle is an car that has a pair of exhaust cylinders that are positioned against the openings defined in the pump when the car is releasably secured to the pump during refilling of a chamber in the car.

10. An improved pneumatic pump for use with a pneumatic toy vehicle powered by a refillable chamber, the improved pneumatic pump comprising:

a pipe having an aperture to exhaust air being pumped out of the pneumatic pump, the pipe having a predetermined diameter to releasably engage the toy vehicle;

the toy vehicle further includes a pneumatic motor that utilizes compressed air in the chamber to propel the vehicle, the pneumatic motor upon activation continuously uses the compressed air in the chamber until the compressed air in the chamber is substantially exhausted and wherein activation of the pneumatic motor is achieved by moving said vehicle; and a means for launching the vehicle from the pneumatic pump, the launching means is defined by having a frame that includes a pin that extends outwardly from the frame, a lever abuts the frame and pivots when pressed downwardly to move the frame such that the pin extends out of an opening defined in a base of the pump.

11. The improved pneumatic pump for use with a pneumatic toy vehicle powered by a refillable compressed chamber of claim 10, wherein the toy vehicle further includes an air inlet valve sized to releasably secure the pipe of the pump such that movement of the vehicle during filling of the chamber is prevented, wherein when the vehicle is releasably secured by said pipe, the vehicle is positioned against the opening defined in the base, whereby when the vehicle is securely engaged by the pipe of the pump and the lever defined by the pump is pushed downwardly, the pin extend out of the opening defined in the base to engage and move the vehicle such that the pneumatic motor is activated and the vehicle launches away from the pump.

* * * * *